US005992977A

United States Patent [19]

Horinaka et al.

[11] Patent Number: 5,992,977

[45] Date of Patent: Nov. 30, 1999

[54] OPTO-THERMAL CONVERSION RECORDING APPARATUS

[75] Inventors: Hajime Horinaka, Kashiba; Hisashi Yoshimura, Nara; Masaharu Kimura, Daito; Hiroshi Onda, Yamatokoriyama; Kohji Tsurui, Sakurai, all of Japan

[73] Assignee: Sharp Kabushiki Kaisha, Osaka, Japan

[21] Appl. No.: 08/788,288

[22] Filed: Jan. 24, 1997

[30] Foreign Application Priority Data

Feb. 9, 1996 [JP] Japan ..... 8-024079

[51] Int. Cl.[6] ..... B41J 2/48

[52] U.S. Cl. ..... 347/51; 347/99; 347/112

[58] Field of Search ..... 347/51, 62, 112, 347/154, 225, 199, 99; 101/453; 430/48

[56] References Cited

U.S. PATENT DOCUMENTS

| | | | |
|---|---|---|---|
| 3,884,686 | 5/1975 | Bean | 430/43 |
| 4,312,009 | 1/1982 | Lange | 347/51 |
| 4,470,055 | 9/1984 | Todoh | 347/199 |
| 4,974,513 | 12/1990 | Yamane et al. | 101/453 |
| 5,142,308 | 8/1992 | Hasegawa et al. | 347/62 |
| 5,471,234 | 11/1995 | Katano et al. | 347/221 |
| 5,604,569 | 2/1997 | Kubota | 399/232 |

FOREIGN PATENT DOCUMENTS

| | | |
|---|---|---|
| 19525786 A1 | 7/1994 | Germany . |
| 4-255392 | 9/1992 | Japan . |

*Primary Examiner*—N. Le
*Assistant Examiner*—Hai C. Pham
*Attorney, Agent, or Firm*—Nixon & Vanderhye P.C.

[57] ABSTRACT

A photoconductive layer is formed on the entire outer peripheral surface of a light transmissive drum, and a conductive layer is formed on the photoconductive layer and is made up of a plurality of strip-like conductive portions. Provided around the drum are a tank for storing thermo-melting ink, a blade which removes surplus ink on the outer peripheral surface of the drum, a drier for drying the ink filling the gaps between the conductive portions in the conductive layers, a platen roller which presses against the outer peripheral surface of the drum with a sheet of recording paper in between, and a light source which is provided inside the drum, facing the inner peripheral surface thereof. When the light source is selectively operated in accordance with image information, current is made to flow between the conductive portions in the conductive layer via the photoconductive layer at image recording areas, thus causing the ink filling the gap to be transferred to the recording paper.

11 Claims, 6 Drawing Sheets

25
19a
19
18
17

19,20
18
17

36
28
19,20
18
17

36
28
19,20
18
17
23

36
25
19,20
18
17
23

25
19,20
18
17

OPTO-THERMAL CONVERSION RECORDING APPARATUS

BACKGROUND OF THE INVENTION (1) Field of the Invention

The present invention relates to an opto-thermal conversion recording apparatus which converts light corresponding to image information into heat to melt thermo-melting ink so that the image information is recorded on a sheet of recording paper.

(2) Description of the Prior Art

Conventionally, as an image recording system, a thermal transfer recording system has been known in which as shown in FIG. 7, an ink ribbon 3 that is composed of a base film 2 and thermo-melting ink 1 applied on a surface thereof is heated by a thermal head 4 so that the thermo-melting ink 1 on the ink ribbon 3 is melted and transferred to a sheet of recording paper 5.

An ink film used in this thermal transfer recording system is expensive and it is very difficult to recycle the ink film which has been once used for a thermal transfer process. Therefore, even if the thermal transfer recording apparatus itself is inexpensive, the running cost due to the consumption of ink films is high. Since the number of recording pixels and the resolution are determined by the number and density of the heat generating elements on the thermal head, development of the head to a higher resolution or provision of a line head increases the cost. Moreover, since the recording trace of the ink which has not been thermally transferred remains as it is on the ink film, this results in poor security protection.

Japanese Patent Application Laid-Open Hei 4 No.255,392 proposes an opto-thermal conversion recording system which uses a heat generating drum 11 having a light transmissive hollow base 6 with a lamination of a transparent electrode layer 7, a photoconductive layer 8, a conductive layer 9 and a thermo-melting ink layer 10 formed thereon in this sequential order, as shown in FIG. 8. In this configuration, with a voltage applied between the transparent electrode layer 7 and the conductive layer 9, rotatable heat generating drum 11 is irradiated with light which contains image information from the inner portion thereof. This causes the photoconductive layer 8 at the illuminated portion thereof to become conductive so that heat is generated by the Joule effect and the ink in thermo-melting ink layer 10 melts and transfers to the recording sheet. Then, ink is supplied to the portion where ink has been transferred, to restore the thermo-melting ink layer to its original state. In this way, this system realizes continuous recording.

However, the opto-thermal conversion recording system disclosed in Japanese Patent Application Laid-Open Hei 4 No.255,392 suffers from the following problems:

1) It is very difficult to create a thermo-melting ink layer of a uniform thickness on a drum;
2) Since ink is transferred to the recording paper whilst the thermo-melting ink layer and the recording paper are being pressurized between the heat generating drum and a platen roll, the ink could adhere to areas other than the recording portions due to friction or the like, polluting the recording sheet; and
3) Since the recorded quality of the pixel area is determined in accordance with an area of the illuminated portions, due to heat diffusion it is impossible to create fine or micro recording pixels which are required for high resolution and high gradation image forming.

SUMMARY OF THE INVENTION

It is therefore an object of the present invention to provide an opto-thermal conversion recording apparatus which is able to create images at high quantity and high resolution, with low running cost.

In accordance with an aspect of the present invention, there is provided an opto-thermal conversion recording apparatus which comprises: a light transmissive base; a photoconductive layer which is formed on the base and exhibits reduced electric resistance when the layer is irradiated with light; a conductive layer which is formed on the photoconductive layer and is made up of a plurality of strip-like conductive portions arranged at regular intervals with constant gaps therebetween; an ink layer which is formed of thermo-melting ink filling the respective gaps in the conductive layer; a light source for irradiating photoconductive layer with light from the base side; and a power source applying a voltage to each of the conductive portions, wherein the adjacent conductive portions become conductive by selectively irradiating the photoconductive layer with light from the light source to cause the ink, formed between the conductive portions, in the ink layer to melt, so that the melted ink is transferred to a sheet of recording paper.

Accordingly, the conductive portions located at image recording areas are made conductive therebetween by irradiating the photoconductive layer at the image recording areas with light from the light source, so that only the ink filling the gap between the conductive portions at that illuminated portion melts and is transferred to the recording paper.

In this way, since the conductive portions located at the image recording areas are made conductive therebetween by irradiating the photoconductive layer at the image recording areas with light from the light source so as to cause only the ink filling the gap between the conductive portions at that illuminated portion to melt and be transferred to the recording paper, it is possible to record images at high quality and high resolution.

In the opto-thermal conversion recording apparatus, it is effective that an ink supplying means which supplies ink to the ink layer at a site of the base is provided, and the base is in the form of an endless rotary body.

In detail, since ink in the ink layer which are located at positions corresponding to image creating areas is transferred to the paper, and then the portions can be repeatedly supplied with ink from the ink supplying means, this configuration makes it possible to constantly fill the whole ink layer with ink prior to the next image recording.

Accordingly, by repeatedly supplying ink from the ink supplying means to the portions in the ink layer where the ink at positions corresponding to image creating areas is transferred to the paper, it is possible to constantly fill the whole ink layer with ink prior to the next image recording. This configuration enables the same base to be used for repeated image recording operations, thus making it possible to realize low running cost.

In the above configuration, it is effective that the ink supplying means comprises: a tank for storing ink; a blade for removing surplus ink from the surface of the base; and a drier for drying the ink filled in the ink layer. Because of this feature, no surplus ink beyond the ink layer will not be left on the surface of the base prior to image recording, and also the ink in the ink layer other than the image recording areas where light from the light source is irradiated will not melt. Therefore, no ink will be transferred to the recording paper except that in the image recording areas.

Accordingly, since no surplus ink beyond the ink layer will be left on the surface of the base prior to image recording, and also the ink in the ink layer other than the image recording areas where light from the light source is illuminated will not melt, no ink will be transferred to the recording paper except in the image recording areas, thus there is no concern that the recording paper might be polluted, degrading the quality of the recording image.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENTS

Figure 1:
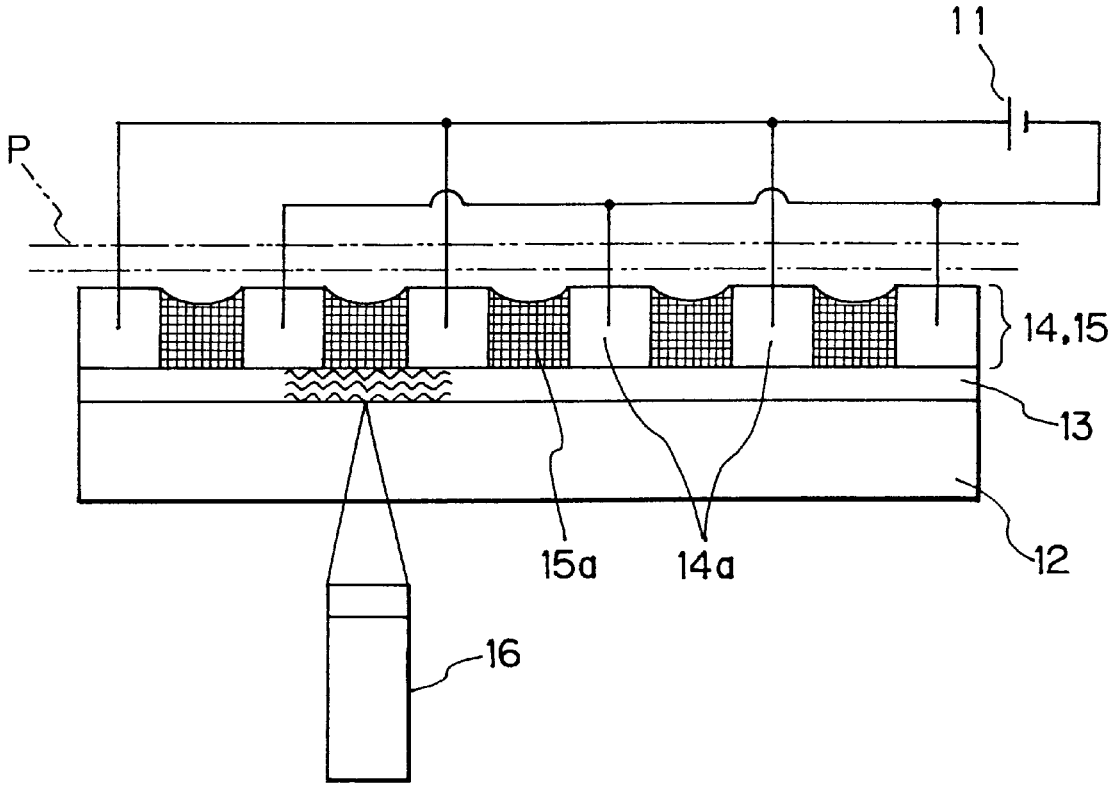
FIG. 1 is a view for illustrating the principle of the recording method in accordance with an opto-thermal conversion recording apparatus of the invention.

FIG. 1 is a view for illustrating the principle of the recording method in an opto-thermal conversion recording apparatus of the invention. A light-transmissive base 12 has a photoconductive layer 13 formed thereon; a conductive layer 14 is formed of a plurality of strip-like conductive portions 14*a* which are arranged on the layer 13 with a constant gap from one to the next. The gaps between conductive portions 14*a* are filled with thermo-melting ink 15*a* forming an ink layer 15. Each conductive portion 14*a* has a voltage applied from a power source 11. The photoconductive layer 13 is selectively irradiated with light from a light source 16 from the base 12 side so as to make adjacent conductive portions 14*a* electrically conductive. The ink 15*a* in the ink layer 15 between conductive portions 14*a* through which a current is flowing melts by the Joule heat generated therebetween and is transferred to a sheet of recording paper P.

Figure 2:
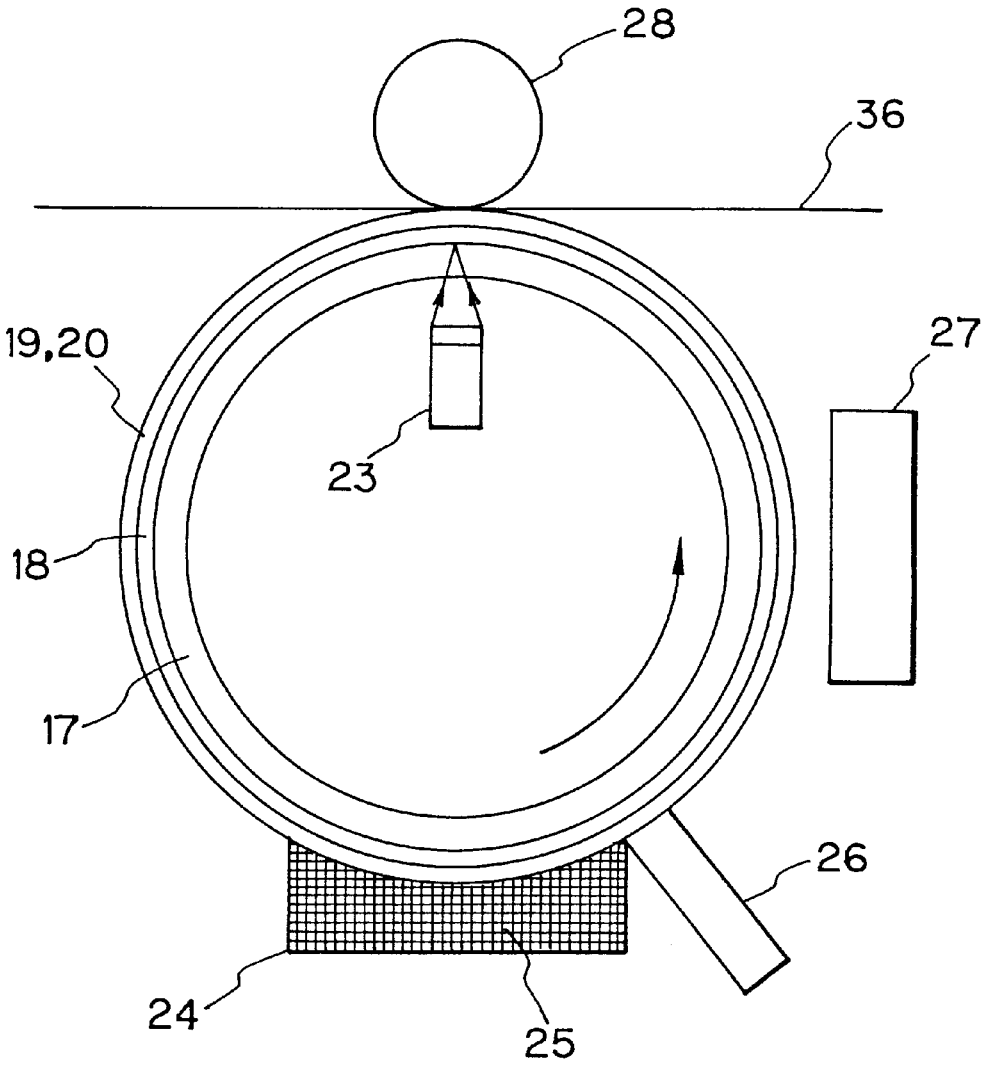
FIG. 2 is a view showing the configuration of essential components of an opto-thermal conversion recording apparatus in accordance with the first embodiment of the invention.

FIG. 2 is a view showing the configuration of essential components of an opto-thermal conversion recording apparatus in accordance with the first embodiment of the invention. A hollowed cylindrical drum 17 which is made up of a light transmissive material such as glass and resin has a photoconductive layer 18 and a conductive layer 19 laminated thereon in this order on the outer peripheral surface thereof. The photoconductive layer 18 may be formed on the whole outer peripheral surface of the drum 17 using a material such as amorphous silicon, selenium and organic photoconductive materials by plasma CVD, sputtering or other well-known methods. The photoconductive layer 18 will reduce its electric resistance value when the layer is exposed to light. The conductive layer 19 is formed of a metal or other conductive materials by well known CVD, sputtering, plating or the like so that a plurality of strip-like conductive portions are arranged at regular intervals in the axial direction with constant gaps therebetween.

Provided around the drum 17 are a tank 24, a blade 26, a dryer 27 and a platen roller 28. The tank 24, the blade 26 and the dryer 27 constitute ink supplying means of this invention. The tank 24 has a thermo-melting ink 25 stored therein, and at least a part of the conductive layer 19 on the outer peripheral surface of the drum 17 is immersed in the ink 25 within the tank 24. The ink 25 stored in the tank 24 may be in the form of a powder type. In this case, the particle size of powder ink should be sufficiently smaller than the dimension of the gap between the conductive portions in the conductive layer 19. In this condition, gaps between the conductive portions in the conductive layer 19 formed on the outer peripheral surface of the drum 17 are filled with the ink forming an ink layer 20. The blade 26 removes surplus ink on the outer peripheral surface of the drum 17 and is formed of a material which is softer than that of the conductive layer 19. The dryer 27 dries the ink in ink layer 20 formed on the outer peripheral surface of the drum 17. The platen roller 28 uniformly abuts the outer peripheral surface of the drum 17 at a constant pressure with a sheet of recording paper 36 in between.

A light source 23 is provided inside the drum 17, facing the inner peripheral surface thereof in the position opposite the platen roller 28 with the drum 17 in between. The light source 23 illuminates the photoconductive layer 18. This light source 23 at least involves wave components whose wavelengths fall within the sensitivity range of the photoconductive layer 18, or which reduces the resistance of the photoconductive layer 18 when the layer is exposed to light. Examples of the light source include light emitting elements such as laser, LED, EL etc., or a lamp with a liquid crystal shutter array.

The gaps between the conductive portions in the conductive layer 19 are subjected to a publicly known lipophilic process so that the gaps between the conductive portions in the conductive layer 19 can be efficiently filled with ink.

Another light source which emits light constantly may be provided inside the drum 17, facing the inner peripheral surface thereof in the position opposite the tank 24 with the drum 17 in between so as to make conductive the portion of the conductive layer 19 of the drum 17 which is immersed in the tank 24, whereby only the ink 25 corresponding to this area inside the tank 24 may melt. This configuration eliminates the necessity for a heater or other means which heats the whole part of the tank 24, making it possible to reduce the power consumption, size and cost of the apparatus.

Further, when a bias voltage is constantly applied to the conductive layer 19, it is possible to have an effect such as facilitating the density adjustment of the ink 25 to be transferred to the recording paper 36.

Additionally, by forming a film made up of an insulating material such as silicon oxide in each gap in the conductive layer 19, it is possible to avoid a short circuit in the conductive layer 19 which might be caused by dust and dirt contaminating the ink 25 filling the ink layer 20.

Moreover, when a voltage is applied between the drum 17 and the platen roller 28, the electrostatic force generated by this applied voltage promotes the transfer of the ink 25 from the ink layer 20 to the recording paper 36.

Figure 3A:
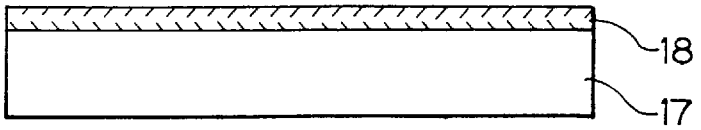
FIGS. 3A through 3F are views showing a forming process of the conductive layer for the drum of the opto-thermal conversion recording apparatus of FIG. 2.
Figure 3B:
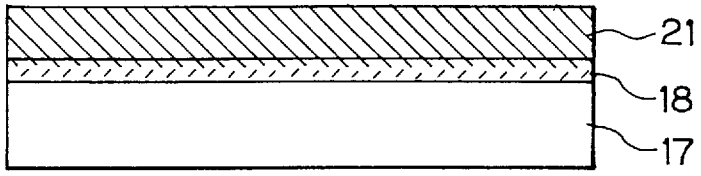
Figure 3C:
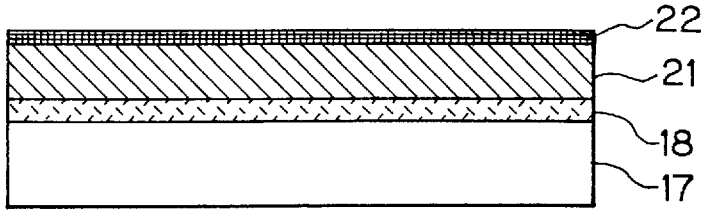
Figure 3D:
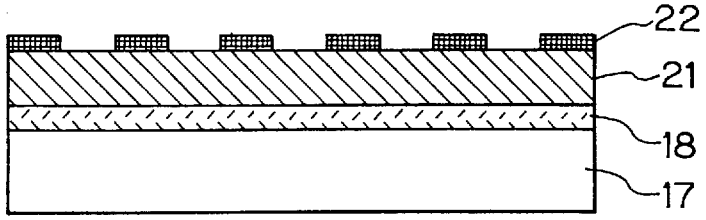
Figure 3E:
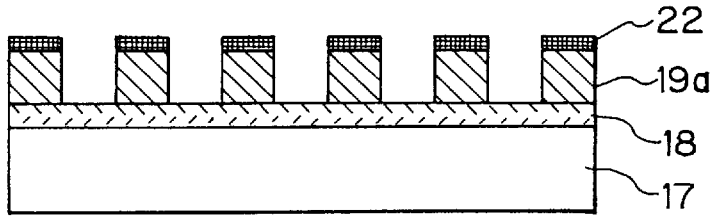
Figure 3F:
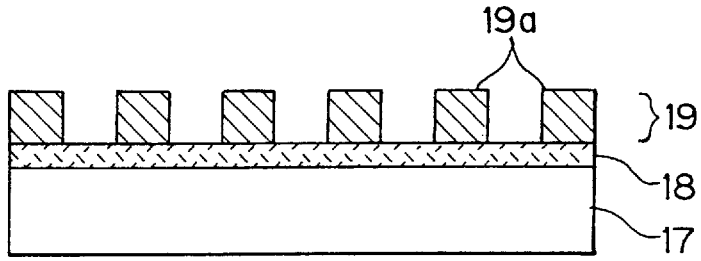

FIGS. 3A–F are procedural views showing the process of forming the conductive layer for the drum of the above opto-thermal conversion recording apparatus. FIG. 3 shows a section of the drum 17 when it is cut by a plane along the axis thereof. As shown in FIG. 3A, the photoconductive layer 18 is formed on the outer peripheral surface of the drum 17 by a publicly known technique such as plasma CVD, sputtering etc., using amorphous silicon, selenium, an organic photoconductive material or the like. Then, a conductive material film 21 is formed over the photoconductive layer 18 by creating a film of metal etc., using a publicly known technique such as CVD, sputtering, plating or the like (FIG. 3B). Formed on this conductive material film 21 is a photoresist film 22 (FIG. 3C) so as to perform patterning with the photoresist (FIG. 3D). Next, removal of the conductive material film from the areas where no photoresist film 22 is formed is effected by wet or dry etching (FIG. 3E). Finally, the photoresist film 22 is removed (FIG. 3F). Thus, by the achievement of the above steps, a number of strip-like conductive portions 19*a* arranged at regular intervals in the axial direction can be formed with constant gaps therebetween. The width of the conductive portion 19*a* and, the gap between the adjacent conductive portions 19*a* which is filled with ink can be finely created by photoresist and etching, thus it is possible to deal with images with high resolution. The conductive layer 19 is composed of a multiple number of the strip-like conductive portions 19*a* as stated above.

Here, it is also possible to form the conductive layer 19 made up of plural strip-like conductive portions 19*a* by forming the photoresist film 22 on the photoconductive layer 18 prior to the formation of the conductive material film 21 and then plating conductive material onto the areas where no photoresist film 22 is formed.

Figures 4A, 4B, 4C, 4D, 4E, 4F:
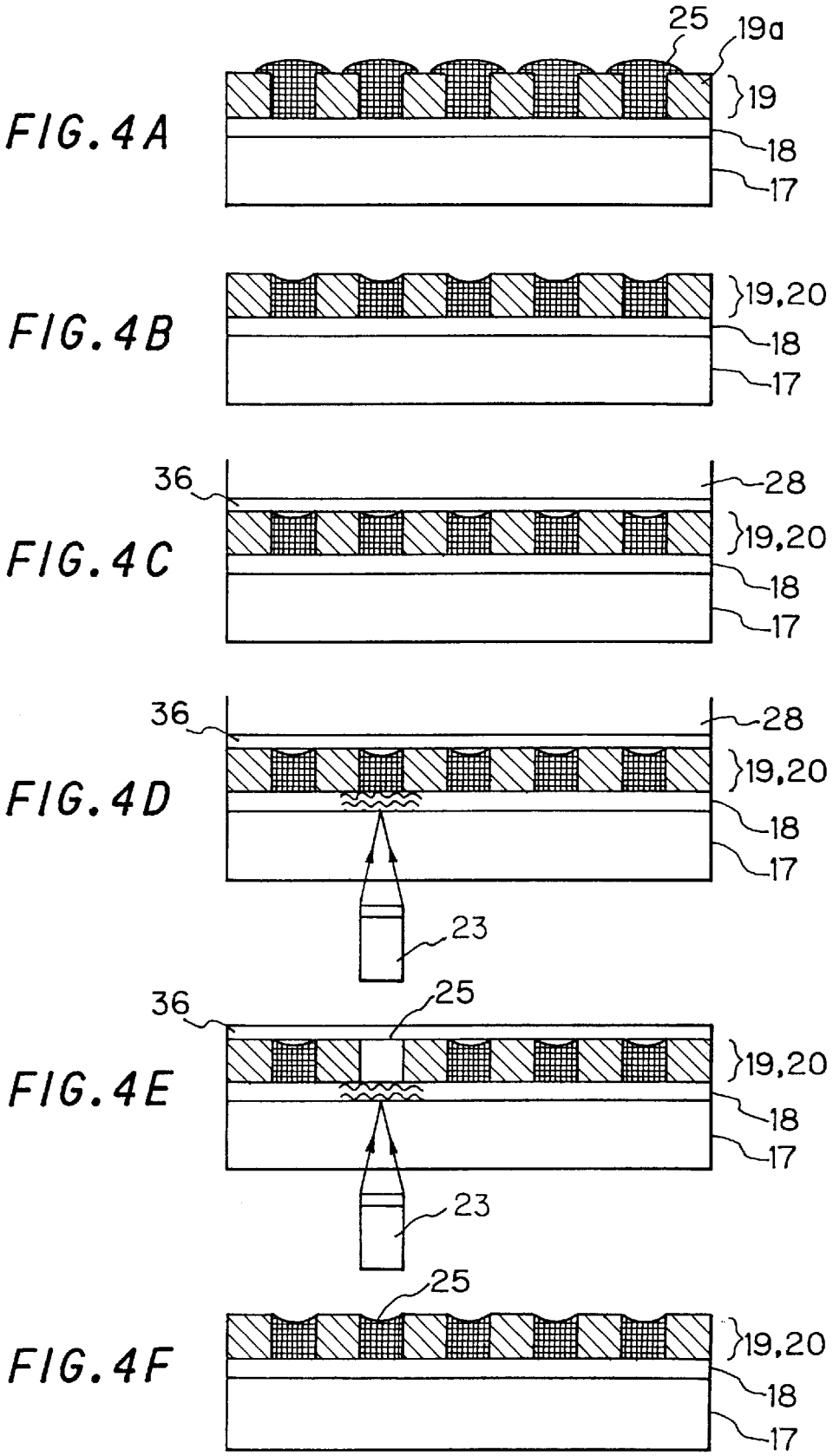
FIGS. 4A through 4F are views showing a recording process of the image in the opto-thermal conversion recording apparatus of FIG. 2.

FIGS. 4A–F are procedural views showing the image recording method of the opto-thermal conversion recording apparatus. As a part of the outer peripheral surface of the drum 17 is immersed in the tank 24, each gap between the conductive portions 19*a* in the conductive layer 19 are filled with the ink 25 as shown in FIG. 4A by capillary action and surface tension force. The blade 26 is abutted on the outer peripheral surface of the ink-filled drum 17 so as to remove the surplus ink 25. Then ink is dried by the drier 27, forming ink layer 20 at the gaps between the conductive portions 19*a* in the conductive layer 19 (FIG. 4B). When reaching the position opposite the platen roller 28, the conductive layer 19 with the ink layer 20 is pressed against the platen roller 28 with the recording paper 36 in between (FIG. 4C). In this figure, the recording paper 36 is conveyed in the direction perpendicular to the document surface.

At this moment, the light source 23 is selectively operated in accordance with the image information so that image recording areas in the photoconductive layer 18 are irradiated with light from the light source 23 passing through the drum base 17 (FIG. 4D). This irradiation with light from the light source 23 causes the ink 25 filling the ink layer 20 to melt at the image recording areas, and thereby to be transferred to the recording paper 36 (FIG. 4E). The areas in the ink layer 20 where the ink 25 has been transferred to the recording paper 36 will again be filled with the ink 25 when the part is next immersed into the tank 24 as the drum 17 rotates (FIG. 4F).

In the above way, when the photoconductive layer 18 is irradiated at image recording areas with light which is emitted from the light source 23 disposed inside the drum 17 and is incident on the inner peripheral surface of the drum, the image recording areas in the ink layer 20 formed of ink 25 filling each gap between the conductive portions 19*a* in the conductive layer 19 are heated by the Joule effect so that the ink 25 filling this portion melts and can be transferred to the recording paper 36. Since the ink layer 20 is formed at gaps between the conductive portions 19*a* which are laminated over the photoconductive layer 18, the ink 25 is supplied into the ink layer 20 by capillary action and surface tension force, and the ink layer 20 can be repeatedly and uniformly filled with the ink 25 when the conductive layer 19 with the ink layer 20 which has undergone image recording is immersed again into the tank 24 as the drum 17 rotates. As a result, it becomes possible to repeat image recording operations using the drum 17.

Figure 5:
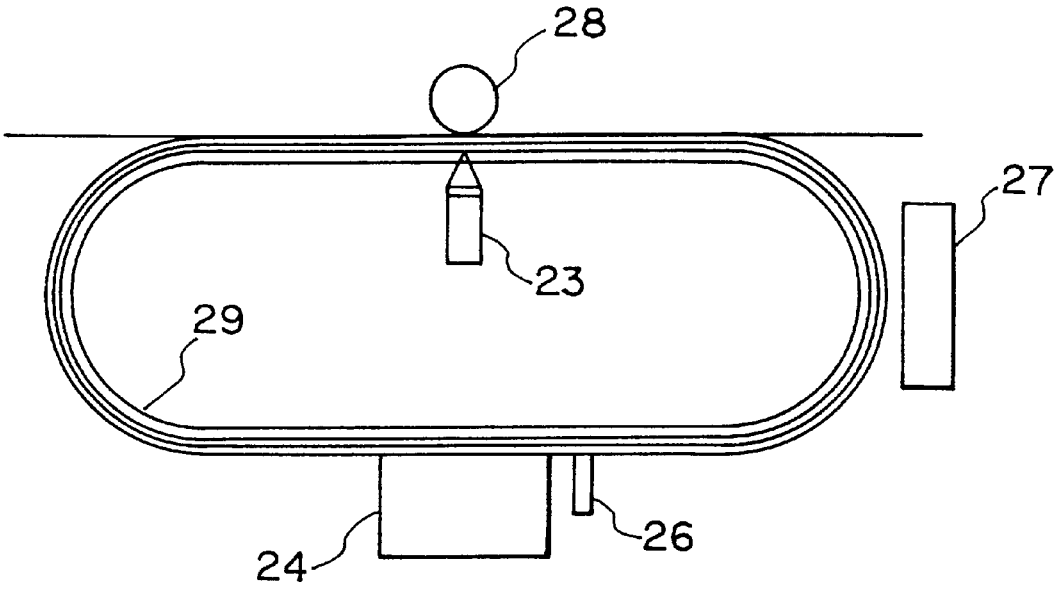
FIG. 5 is a view showing the configuration of an opto-thermal conversion recording apparatus in accordance with another embodiment of the invention.

FIG. 5 is a view showing the configuration of an opto-thermal conversion recording apparatus in accordance with another embodiment of the invention. In this embodiment, a light-transmissive endless belt 29 which is formed from resin etc. is used in place of the drum 17 shown in FIG. 2. Other complements are the same with those shown in FIG. 2.

Thus, the use of the endless belt 29 makes it possible to reduce the size and cost of the apparatus.

Figure 6:
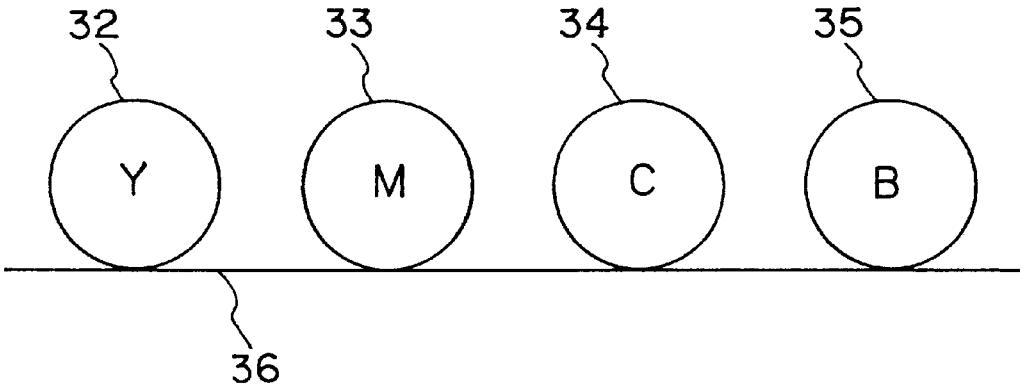
FIG. 6 is a view showing the configuration of an opto-thermal conversion recording apparatus in accordance with a further embodiment of the invention.
Figure 7:
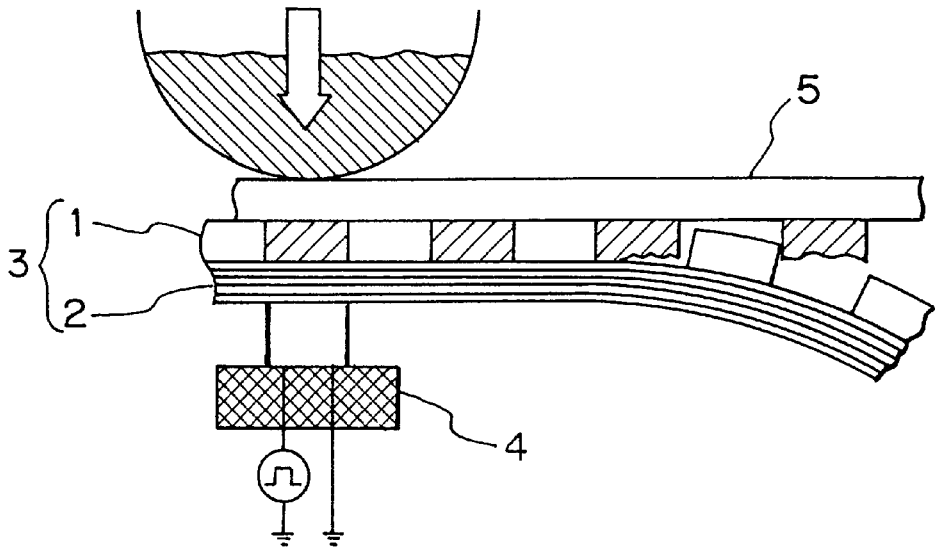
FIG. 7 PRIOR ART
FIG. 7 is a view showing the image recording method of a conventional thermal transfer system.
Figure 8:
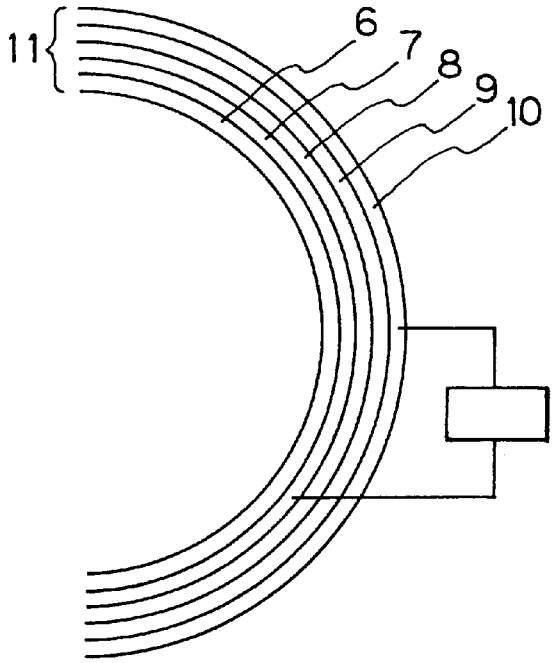
FIG. 8 PRIOR ART
FIG. 8 is a view showing the image recording method of a conventional opto-thermal conversion recording system.

FIG. 6 is a view showing the configuration of an opto-thermal conversion recording apparatus in accordance with a further embodiment of the invention. In this embodiment, four drums 32 to 35, for yellow (Y), magenta (M), cyan (C) and black (B), which have the same configuration as FIG. 2, are arranged. This arrangement makes it possible to record color images on the recording paper.

What is claimed is:

1. An opto-thermal conversion recording apparatus comprising:

a light transmissive base;

a photoconductive layer which is formed on the base and exhibits reduced electric resistance when the layer is irradiated with light;

a conductive layer which is formed on the photoconductive layer and is made up of a plurality of strip-like conductive portions arranged at regular intervals with constant gaps therebetween, whereby the photoconductive layer is sandwiched between the base and the conductive layer;

an ink layer which is formed of thermo-melting ink filling respective ones of the constant gaps in the conductive layer without covering radially exterior surfaces of the conductive portions;

a light source for irradiating the photoconductive layer with light from the base side; and a power source applying a voltage to each of the conductive portions, wherein adjacent conductive portions become conductive by selectively irradiating the photoconductive layer with light from the light source to cause the ink, formed between the conductive portions, in the ink layer to melt, so that the melted ink is transferred to a sheet of recording paper.

2. An opto-thermal conversion recording apparatus according to claim 1, further comprising an ink supplying means for supplying ink to the ink layer at a site of the base, wherein the base is in the form of an endless rotary body.

3. An opto-thermal conversion recording apparatus according to claim 2, wherein the ink supplying means comprises: a tank for storing ink; a blade for removing surplus ink from the surface of the base; and a drier for drying the ink filled in the ink layer.

4. An opto-thermal conversion recording apparatus according to claim 3, further comprising a light source which constantly irradiates a position opposite to the tank with light.

5. An opto-thermal conversion recording apparatus according to claim 1, wherein each gap in the conductive layer is subjected to a lipophilic process.

6. An opto-thermal conversion recording apparatus according to claim 1, wherein the power source constantly applies a bias voltage to the conductive layer.

7. An opto-thermal conversion recording apparatus according to claim 1, wherein each gap in the conductive layer is provided with a film of insulating material.

8. An opto-thermal conversion recording apparatus comprising:

a light transmissive base;

a photoconductive layer formed on the base, the photoconductive layer being formed of a material that exhibits reduced electric resistance when irradiated with light;

a patterned conductive layer formed on the photoconductive layer via a photoresist, whereby the photoconductive layer is sandwiched between the base and the conductive layer, the patterned conductive layer including a plurality of strip-like conductive portions arranged at regular intervals with constant gaps therebetween;

an ink layer formed of thermo-melting ink filling respective ones of the constant gaps in the conductive layer;

a light source disposed adjacent the photoconductive layer; and a power source coupled with each of the conductive portions.

9. An opto-thermal conversion recording apparatus according to claim 8, wherein the patterned conductive layer comprises etched portions defining the strip-like conductive portions.

10. An opto-thermal conversion recording apparatus according to claim 8, wherein the ink layer fills the respective ones of the constant gaps in the conductive layer without covering radially exterior surfaces of the conductive portions.

11. An opto-thermal conversion recording apparatus comprising:

a light transmissive base;

a uniform photoconductive layer formed on the base, the uniform photoconductive layer being formed of a material that exhibits reduced electric resistance when irradiated with light;

a conductive layer formed on the uniform photoconductive layer, whereby the photoconductive layer is sandwiched between the base and the conductive layer, the conductive layer including a plurality of strip-like conductive portions arranged at regular intervals with constant gaps therebetween;

an ink layer formed of thermo-melting ink filling respective ones of the constant gaps in the conductive layer;

a light source disposed adjacent the photoconductive layer; and a power source coupled with each of the conductive portions.

* * * * *